US006966851B1

(12) United States Patent
England et al.

(10) Patent No.: US 6,966,851 B1
(45) Date of Patent: Nov. 22, 2005

(54) HAT WITH BALL MARKER

(76) Inventors: Karen Ann England, 39 E. Galvez Ct., Pensacola Beach, FL (US) 32561; Robert L. England, 39 E. Galvez Ct., Pensacola Beach, FL (US) 32561

( * ) Notice: Subject to any disclaimer, the term of this patent is extended or adjusted under 35 U.S.C. 154(b) by 0 days.

(21) Appl. No.: 10/781,502

(22) Filed: Feb. 18, 2004

(51) Int. Cl.[7] ..... A63B 57/00
(52) U.S. Cl. ..... 473/406; 2/209.13
(58) Field of Search ..... 473/406, 285; 224/918; 2/209.13, 161.1, 161.2

(56) References Cited

U.S. PATENT DOCUMENTS 3,233,802 A * 2/1966 Ludwick ..... 224/918
3,462,862 A * 8/1969 Chase ..... 224/918
4,822,052 A * 4/1989 Dimmick et al. ..... 473/285
5,305,999 A * 4/1994 Tate ..... 473/406
5,898,946 A 5/1999 Keating et al.
5,930,839 A 8/1999 Schupp
5,996,116 A 12/1999 Tate
6,163,889 A * 12/2000 Tate ..... 2/209.13
6,357,642 B1 3/2002 Marchessault et al.
6,422,955 B1 7/2002 Lopez
6,457,184 B1 10/2002 Adams
6,513,165 B1 * 2/2003 England et al. ..... 2/161.1
6,564,391 B2 5/2003 Shwartz et al.
6,569,039 B1 * 5/2003 Cope ..... 473/406
6,820,282 B1 * 11/2004 England et al. ..... 2/161.1

* cited by examiner

*Primary Examiner*—Steven Wong
(74) *Attorney, Agent, or Firm*—Peter Loffler

(57) ABSTRACT

A hat with ball marker removably places a golf ball marker onto a cap for retrieval therefrom by a golfer. The device has a hat having a dome with an opening and an insert that has a base with a wing such that the wing is attached to an inner surface of the dome and the base protrudes through the opening. The upper surface of the base is magnetized and the marker, being magnetically attractive, is magnetically removably attached to the base. Removal of the marker from the base is accomplished by sliding the marker off of the base or by providing the base with a cavity such that placement of force onto the marker above and toward the cavity causes the marker to teeter thereby flipping the marker into the cavity for easy removal.

11 Claims, 4 Drawing Sheets

HAT WITH BALL MARKER

BACKGROUND OF THE INVENTION

1. Field of the Invention

The present invention relates to a hat that has a ball marker magnetically attached to the cap, which marker is readily detached from the cap.

2. Background of the Prior Art

In the game of golf, it is customary, upon landing on the green, to mark the position of a player's golf ball with an appropriate marker and remove the ball from the playing green. Removal of the ball is typically performed for one of two purposes. Either the golf ball lies in the shot path of another golfer's ball that is further from the hole—the farthest player from the hole shoots first when on the green—and the ball is removed so as not to be hit during the other player's shot. While the other shooter may still hit the marker with the ball, by using markers that are small and relatively flat, such hitting of the marker results in substantially less deflection than would occur if another ball was hit. Additionally, a player may desire to pick the ball up and clean the ball upon reaching the green. As the ball can accumulate grass and other debris during hole play, which debris can result in putting inaccuracy, picking up and cleaning the ball upon reaching the green, which is legal and proper, is a common practice.

Many golfers use a coin or other similar flat article as a ball marker. The coin or similar marker is retrieved from the golfer's pocket and positioned on the green at the spot of the ball. Once the golf ball is placed back onto the green, the marker is retrieved and placed back into the player's pocket. This system works reasonably well but is not without its drawbacks. If a player has a pocket full of other items in addition to the ball, such as car keys, pencils, golf tees, golf balls, etc., the golfer may have some difficulty in finding the desired marker tending to slow the overall pace of the game. This is especially true if a golfer desires to use a specific or favorite marker each time. Such a golfer may retrieve several coins from the pocket before retrieving the sought after marker. In fumbling through the pockets to retrieve the marker, the golfer may spill some of the other items out of the pocket, which items must be retrieved and replaced, further slowing the pace of play. Multiply this scenario by 18 holes and a substantial amount of lost time can be achieved.

In order to address this situation, dedicated golf ball markers have been proposed wherein such markers are worn on the clothing of the golfer. The golfer's hat is a natural clothing choice as most golfers will not be found without their hats on the links. Such markers are positioned on the hat and retrieved as needed and thereafter replaced, thereby eliminating the need to fumble through pockets of the golfer or within pockets of the golf bag. This allows a golfer to have a marker in the same position every time a marker is needed. However, the prior art systems also have drawbacks.

Some such systems tend to be relatively complex in design and construction making such devices relatively expensive to manufacture and obtain. Although the sport of golf tends to be a relatively expensive game, there is no need to add unnecessary expense where such expense is not warranted. Some prior art systems make retrieval of the marker from and replacement of the marker back onto the hat relatively difficult. Such systems may require that the golfer have a fair amount of dexterity in the fingers or even fairly grown nails to effectively retrieve the marker from the hat. Other systems require that the golfer remove the hat in order to either retrieve the marker, replace the marker or both. Not only do golfers do not like to have to remove their hats when not desired, but such removal lessens the time savings desired by such dedicated marker holding systems. Still other dedicated ball marker systems are positioned on the hat in an awkward place so as to look unnatural or are positioned out of the normal line of site of others. Proper marker positioning is important as many golfers consider the marker a fashionable item and may sport different markers on different days on the same hat.

Therefore, there exists a need in the art for a dedicated ball marker system that removably attaches to a golfer's hat which addresses the above stated shortcomings in the art. Specifically, such a ball marker system must be of relatively simple and straightforward design and construction and must allow a golfer to be able to quickly and easily retrieve the marker from the hat and thereafter return the marker to its proper position on the hat without undue fuss and without the need to remove the hat. The dedicated marker system must be positioned in a natural appearing place on the hat such that it is in the normal line of site of others with which the golfer interacts.

SUMMARY OF THE INVENTION

The hat with ball marker of the present system addresses the aforementioned needs in the art. The hat with ball marker provides a dedicated ball marker system wherein the marker removably attaches to a golfer's hat. The hat with ball marker is of relatively simple and straightforward design and construction and allows a golfer to be able to quickly and easily retrieve the marker from the hat and thereafter return the marker to its proper position on the hat without undue fuss and without the need to remove the hat. The present invention positions the marker on the hat in a natural appearing place such that the marker is in the normal line of site of others with which the golfer interacts with so that the marker can be a item of the overall fashion statement made by the golfer.

The hat with ball marker of the present invention is comprised of a hat that has a dome with an inner surface, an outer surface, and an opening. An insert that has a base member with a magnetized upper surface, a lower surface, and a wing is affixed to the hat such that the wing is attached to the inner surface of the dome with the base member protruding through the opening of the dome and facing outwardly. A marker has a top surface and a bottom surface such that the bottom surface is magnetically attached to the magnetized upper surface of the base member. The marker may be slid off of the base member in order to retrieve the marker or the base member may have a cavity such that a portion of the marker overlies the cavity whenever the marker is magnetically attached to the upper surface of the base member and such that when downward force is placed on the top surface of the marker above the cavity, the marker teeters against an edge of the base member into the cavity allowing retrieval of the marker. An arcuate ring member may extend circumferentially about the upper surface of the base member with the ring member having a discontinuity located proximate the cavity. The entire upper surface of the base member may be magnetized or only a portion of the upper surface of the base member is magnetized. The wing may extend circumferentially around the base member or only a portion thereof. The wing may be adhered to the inner surface of the dome or the wing may be stitched to the inner surface of the dome.

BRIEF DESCRIPTION OF THE DRAWINGS

Similar reference numerals refer to similar parts throughout the several views of the drawings.

DESCRIPTION OF THE PREFERRED EMBODIMENT

Figure 1:
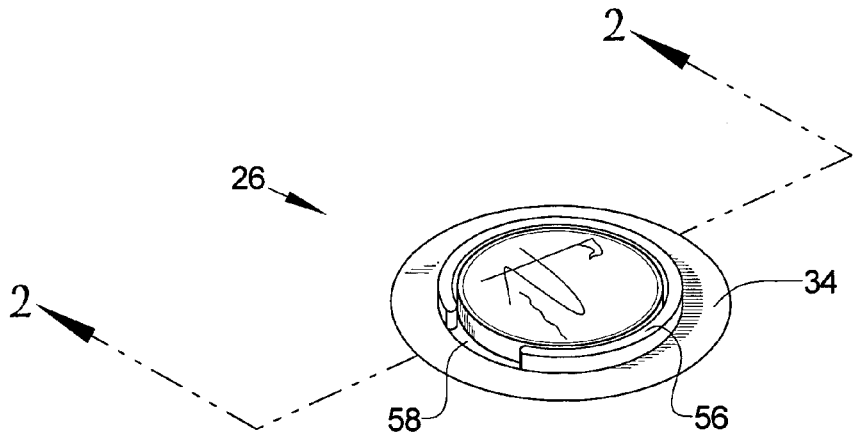
FIG. 1 is a perspective view of the hat with ball marker of the present invention.

Referring now to the drawings, it is seen that the hat with ball marker of the present invention, generally denoted by reference numeral 10, is comprised of a hat 12 of any appropriate design in the art (including visors) that may have a dome 14 having an outer surface 16, a inner surface 18, a bill 20, and a sizing strap 22. An opening 24 is located on the dome 14. An insert 26 is provided which insert 26 has a base member 28 with a magnetic upper surface 30 and a lower surface 32 and a flexible wing 34. The insert 26 is positioned such that the wing 34 is positioned against and attached to the inner surface 18 of the dome 14 by any appropriate means such as by use of an appropriate adhesive or as illustrated by appropriate stitching 36 through the wing 34 and the dome 14. The wing 34 may, but need not necessarily extend circumferentially about the entire base member 28. Advantageously, although not necessarily, the insert is located on the right side of the hat 12 (the right side being defined as that portion being worn on the right side of the user) just behind the bill 20 as most golfers tend to be right handed and will want to use the right hand to use the device 10.

A marker 38 is provided and has a top surface 40 that may have a desired aesthetic design thereon, and a bottom surface 42, the bottom surface 42 of the marker 38 being made from a magnetically attractive material such as metal. The marker 38 is magnetically attached to the magnetic upper surface 30 of the base member 28 and magnetically held thereat until retrieval of the marker 38 is desired. The magnetic strength of the magnetic upper surface 30 of the base member 28 is such so as to hold the marker 38 properly in place during normal hat 12 use but not so strong as to make detachment of the marker 38 from the base member 28 unusually difficult.

Retrieval of the marker 38 from the base member 28 may be accomplished in one of two ways. As seen in FIGS. 1–9, the base member 28 has a cavity 44 such that when the marker 38 is magnetically attached to the base member 28, a portion of the marker 38 overlies the cavity 44. When detachment of the marker 38 from the base member 28 is desired, a downward force is placed onto the top surface 40 of the marker 38 at a point where the marker 38 overlies the cavity 44. The causes the marker 38 to teeter or otherwise pivot about an edge of the upper surface 30 of the base member 28 causing a portion of the marker 38 to go into the cavity 44. Correspondingly, the other portion of the maker 38—that portion located on the opposing side of the pivot line of the base member 28—flips upwardly away from the magnetic upper surface 30 of the base member 28. This flipped opposing side of the marker 38 can now be easily grasped by the fingers of the user and pulled away from the base member 28 and the marker 38 used as desired.

Figure 2:
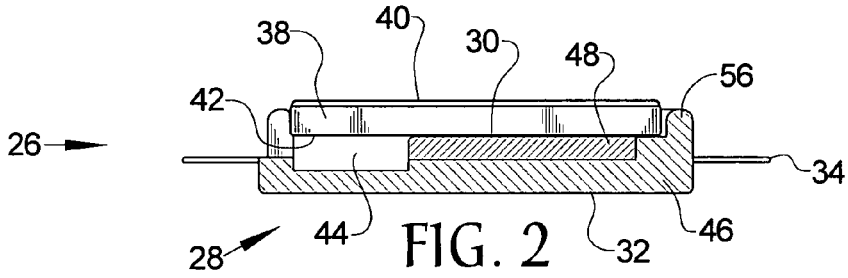
FIG. 2 is a sectional side view of the hat with ball marker of the present invention taken along line 2—2 in FIG. 1.
Figure 3:
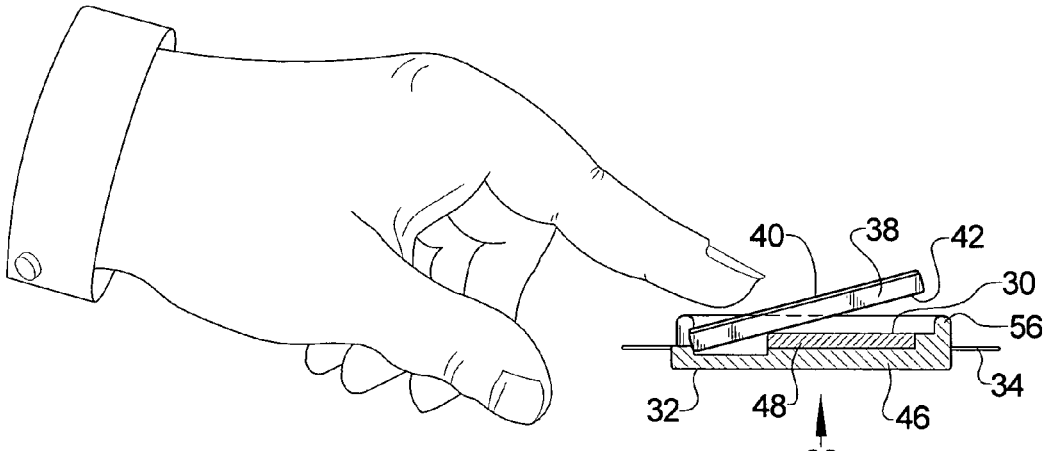
FIG. 3 is an elevation/section view of the hat with ball marker illustrating the removal of the marker.
Figure 4:
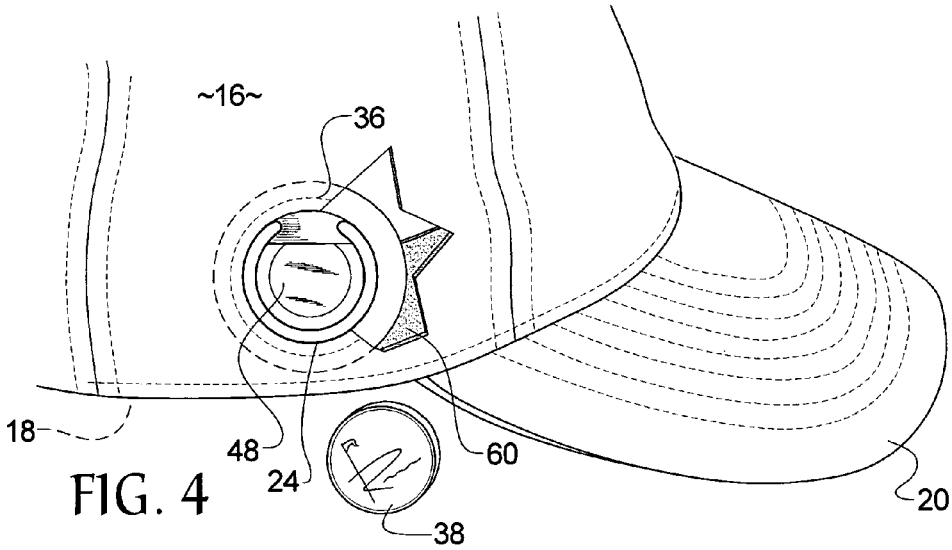
FIG. 4 is a partial cutaway view of the hat with ball marker.
Figure 5:
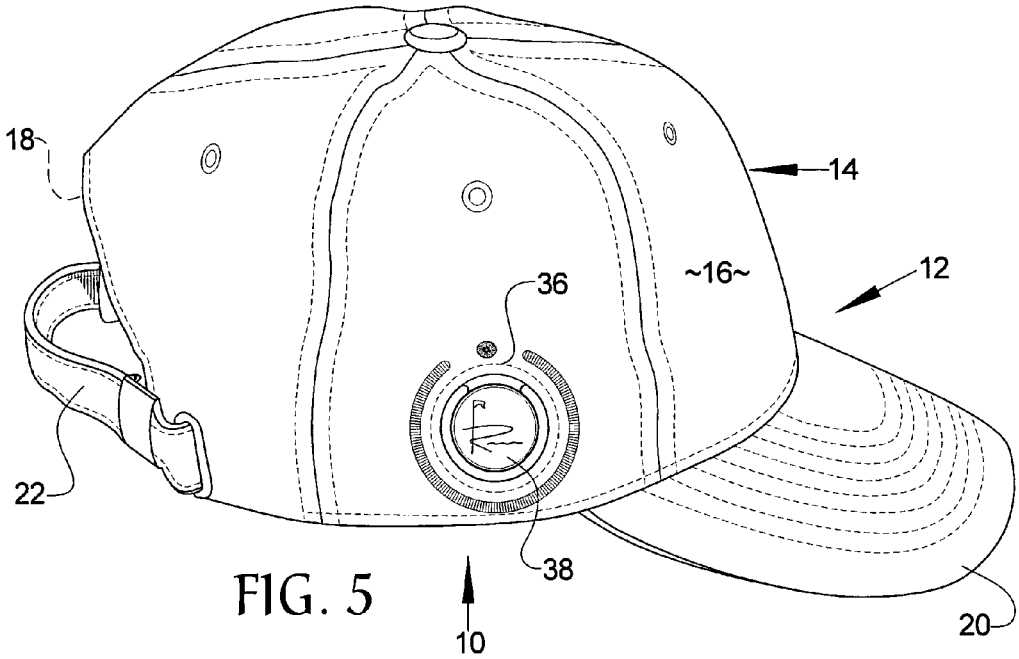
FIG. 5 is a perspective view of the hat with ball marker of the present invention.
Figure 6:
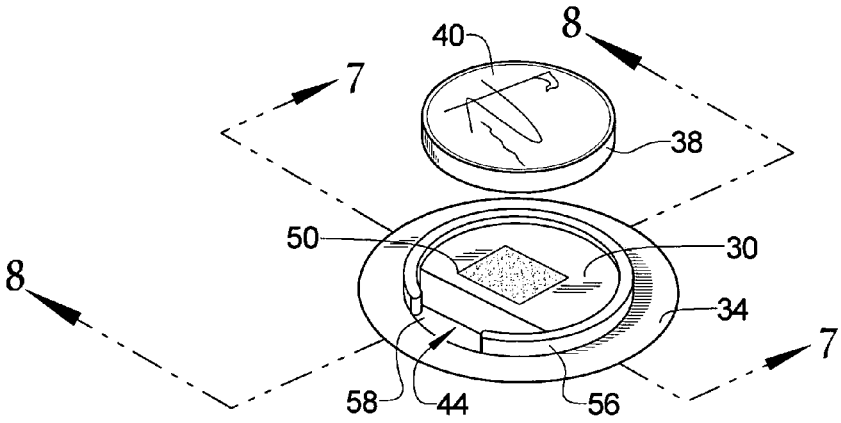
FIG. 6 is a perspective view of the hat with ball marker with an alternate architecture of the magnet.

As best seen in FIGS. 2–4, the entire upper surface 30 of the base member 28 can be made from a magnetic material. This is accomplished by having the lower section 46 of the base member 28 made from a first material, such as plastic, and having the upper section 48 of the base member being made from a magnetic material (flexible magnet, rare earth permanent magnet etc.). The lower section 46 can be mated to the upper section 48 by any appropriate means such as by adhesion, etc.

Figure 7:
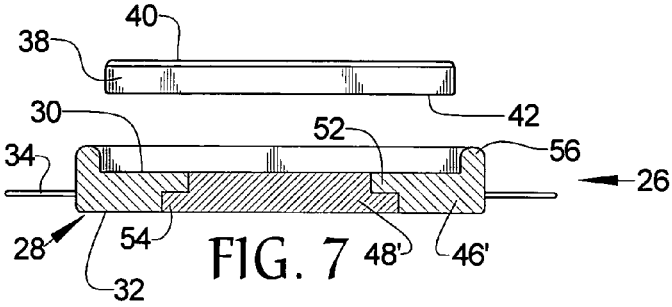
FIG. 7 is a sectional side view of the hat with ball marker with the alternate architecture of the magnet taken along line 7—7 in FIG. 6.
Figure 8:
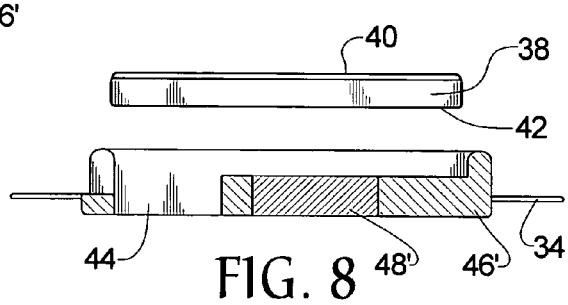
FIG. 8 is a sectioned side view of the hat with ball marker with the alternate architecture of the magnet taken along line 8—8 in FIG. 6.
Figure 9:
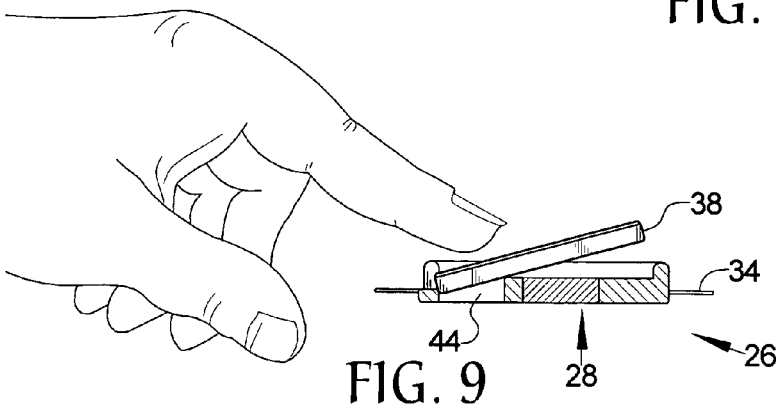
FIG. 9 is an elevation/section view of the hat with ball marker of FIG. 6 illustrating the removal of the marker.
Figure 10:
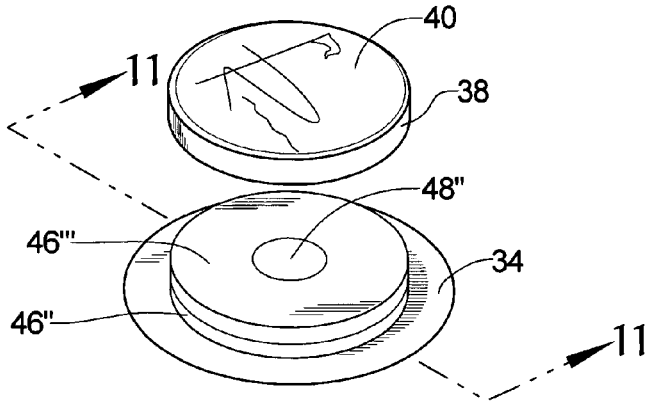
FIG. 10 is a perspective view of an alternate embodiment of the hat with ball marker of the present invention.
Figure 11:
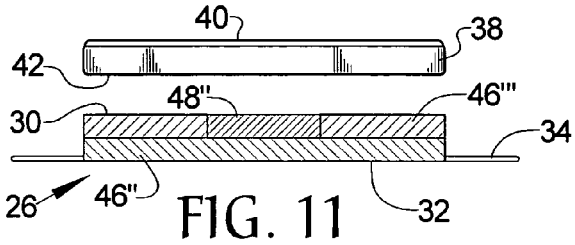
FIG. 11 is a sectional view of the alternate embodiment of the hat with ball marker taken along line 11—11 in FIG. 10.
Figure 12:
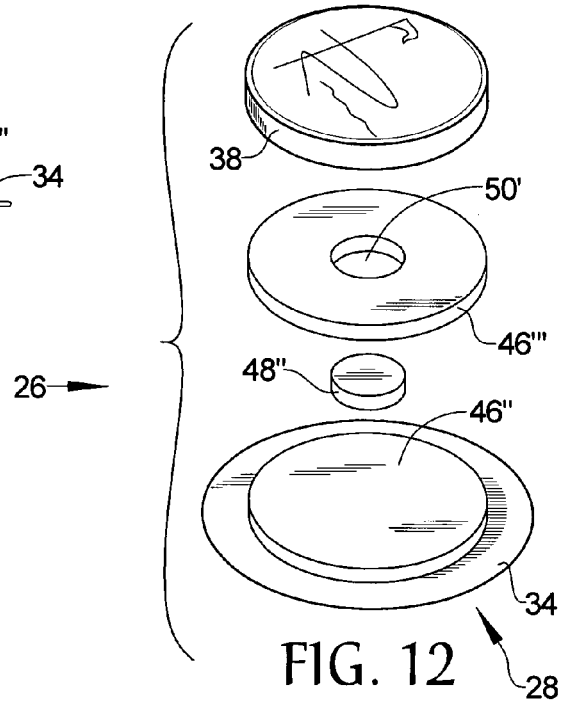
FIG. 12 is an exploded view of the alternate embodiment of the hat with ball marker.
Figure 13:
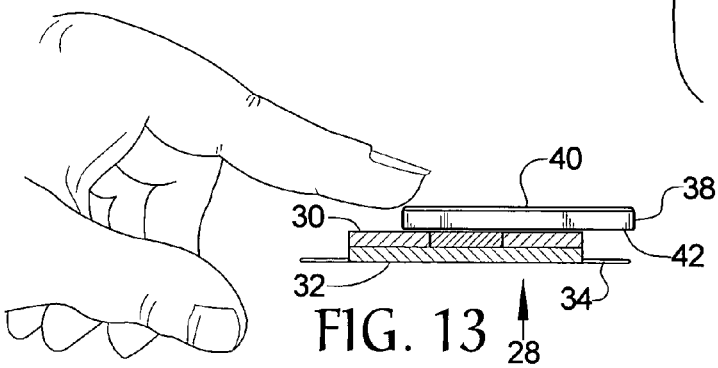
FIG. 13 is an elevation/section view of the alternate embodiment of the hat with ball marker of FIG. 10 illustrating the removal of the marker.

Alternately, as best seen in FIGS. 6–9, only a portion of the upper surface 30 of the base member 28 may be made from a magnetic material. This can be accomplished by having the lower section 46' of the base member 28 comprise a portion of the upper surface 30 of the base member 28, this lower section 46' having an opening 50 at the upper surface 30. The upper section 48' of the base member 28, which is magnetic, is positioned within this opening 50. As seen in FIG. 7, in order to facilitate smooth nesting of this lower section 46' with this upper section 48' of the base member 28, the lower section 46' can having upwardly facing mounting shoulders 52 that mate with downwardly facing mounting shoulders 54 on the upper section 48'. These mounting shoulders 52 and 54 allow a smooth and snug interfit between lower section 46' and upper section 48'. The lower section 46' can be mated to the upper section 48' by any appropriate means such as by adhesion, etc.

In either magnet architecture, an arcuate ring 56 is positioned about the upper surface 30 of the base member 28 such that the marker 38 is received by the base member 28 within the ring 56. The ring 56 has a discontinuity 58 located proximate the cavity 44.

In use, this embodiment of the hat with ball marker 10 of the present invention has the insert 26 placed within the dome 14 of the hat 12 such that the wing 34 of the base member 28 faces the inner surface 18 of the dome 14 with the base member 28 protruding through the opening 24 and the wing 34 is attached to the inner surface 18 of the dome 14 in appropriate fashion. The wing 34 may have additional layers of the hat 12, such as the illustrated headband 60, located beyond the wing 34 such that there may be additional inner layers of the hat 12 disposed between the device 10 and the user's head with the wing 34 sandwiched in between the layers. The marker 38 is magnetically attached to the upper surface of the base member 28 and held thereat. The hat 12 is worn by a user as desired. When retrieval of the marker 38 is desired, the user places downward force on the top surface 40 of the marker 38 in order to pivot this portion of the marker 38 into the cavity 44 and flip the opposing portion of the marker 38 diagonally upwardly. The marker 38 is grasped by the user and removed from the base member 28. The ring 56, the profile of which protrudes through the dome 14, provides the user a tactile guide to the marker 38 and to the appropriate portion of the marker 38 upon which to place the downward force in order to achieve the desired flipping of the marker 38 with respect to the base member 28 as well as a tactile guide for replacement of the marker 38 back onto the base member 28 when use of the marker 38 is no longer desired. The cavity 44 of the base member 28 and the corresponding discontinuity 58 of the ring 56 may be located at any desired orientation, although positioning each at either 12 o'clock or 3 o'clock, when looking at the insert 26 on the hat 12 has proved to be highly effective.

Alternately, as best seen in FIGS. 10–13, the marker 38 may be retrieved from the base member 28 by sliding the marker 38 off of the base member 28. To best accomplish this sliding, it is desirable that less than the entire upper surface 30 of the base member 28 be magnetized. This can be accomplished by providing an architecture of the base member 28 similar to that illustrated in FIGS. 6–9 or by providing the alternate architecture illustrated in FIGS. 10–13. In this alternate architecture, the base member 28 has a first lower section 46" and a second lower section 46'" attached to tie first lower section 46" in appropriate fashion, the second (or upper) lower section 46'" having an opening 50' therein. The magnetized upper section 48" of the base member 28 is positioned within the opening 50' of the second lower section 46'". In either architecture, the use of a less than fully magnetized upper surface 30 of the base member 28 allows for firm holding of the marker 38 to the base member 28 but also allows relatively easy sliding of the marker 38 off of the base member 28 when marker 38 retrieval is desired. In this embodiment the hat 12 is again worn by a user as desired. When retrieval of the marker 38 is desired, the user slides the marker 38 along the base member 28 and when a sufficient portion of the marker 38 has cleared the limits of the base member 28, the user grasps the marker 38, removes the marker 38 from the magnetic grasp of the base member 28, and uses the marker 38 as desired. The marker 38 is replaced onto the base member 28 by simply positioning the marker 38 onto the base member 28 and allowing the base member 28 to magnetically attract and hold the marker 38. If needed, the marker's position with respect to the base member 28 can be fine tuned by sliding the marker 38 into the final desired location. If desired, a ring (not illustrated) can be used to provide the user tactile guidance in retrieving and replacing the marker 38 with respect to the base member 28. Such a ring member has an appropriately sized discontinuity to allow the marker 38 to slide with respect to the base member 28 without being unnecessarily impeded by the ring.

While the invention has been particularly shown and described with reference to embodiments thereof, it will be appreciated by those skilled in the art that various changes in form and detail may be made without departing from the spirit and scope of the invention.

We claim:

1. A ball marking system comprising:

a hat having a dome with a concave inner surface adapted to receive a wearer's head, a corresponding convex outer surface and an opening having a first diameter;

an insert having a base member the base member having a second diameter that is no greater than the first diameter and having a magnetized a first upper surface, a first lower surface, and a wing extending outwardly from an outer circumference of the base member, the wing having a second upper surface that faces in the same direction as the first upper surface and having a second lower surface and such that the wing is attached to the inner surface of the dome by mating the second upper surface of the wing with the inner surface of the dome with the base member protruding through the opening of the dome; and a marker having a top surface and a bottom surface, the bottom surface magnetically attached to the first upper surface of the base member.

2. The ball marker as in claim 1 wherein the base member has a cavity such that a portion of the marker overlies the cavity whenever the marker is magnetically attached to the first upper surface of the base member and such that when force is placed on the top surface of the marker above the cavity, the marker teeters against an edge of the base member into the cavity.

3. The ball marker as in claim 2 further comprising an arcuate ring member extending circumferentially about the first upper surface of the base member.

4. The ball marker as in claim 3 wherein the ring member has a discontinuity located proximate the cavity.

5. The ball marker as in claim 1 further comprising an arcuate ring member extending circumferentially about the first upper surface of the base member.

6. The ball marker as in claim 1 wherein the entire first upper surface of the base member is magnetized.

7. The ball marker as in claim 1 wherein the less than the entire first upper surface of the base member is magnetized.

8. The ball marker as in claim 1 wherein the wing extends circumferentially around the base member.

9. The ball marker as in claim 1 wherein the wing is adhered to the inner surface of the dome.

10. The ball marker as in claim 1 wherein the wing is stitched to the inner surface of the dome.

11. The ball marker as in claim 1 wherein the bottom surface of the marker is flat.

* * * * *